US005387469A

United States Patent [19]

Warren

[11] Patent Number: 5,387,469

[45] Date of Patent: Feb. 7, 1995

[54] MULTILOBAL FIBER WITH PROJECTIONS ON EACH LOBE FOR CARPET YARNS

[75] Inventor: Elbert K. Warren, Candler, N.C.

[73] Assignee: BASF Corporation, Parsippany, N.J.

[21] Appl. No.: 239,498

[22] Filed: May 9, 1994

Related U.S. Application Data

[63] Continuation-in-part of Ser. No. 967,003, Oct. 27, 1992, abandoned.

[51] Int. Cl.[6] ..... D02G 3/00

[52] U.S. Cl. ..... 428/397; 428/364; 428/92; 428/400

[58] Field of Search ..... 428/92, 364, 397, 400; 264/177.13

[56] References Cited

U.S. PATENT DOCUMENTS

| | | | |
|---|---|---|---|
| 3,673,053 | 6/1972 | Shimoda et al. | 264/177.13 |
| 4,812,361 | 3/1989 | Takemoto et al. | 264/177.13 |
| 5,108,838 | 4/1992 | Tung | 428/397 |
| 5,263,845 | 11/1993 | Warren | 425/461 |

*Primary Examiner*—N. Edwards

[57] ABSTRACT

Described is a synthetic fiber for use in carpets, having a multilobal cross section, each lobe of said multilobal cross section having a first end and a second end and one side and an opposite side, the first end of each of said lobes being connected to the first end of the other lobes, the second end of each of said lobes radiating outwardly, each lobe having a plurality of projections, alternating along a contour of each lobe, each projection of each lobe having no direct counterpart on the opposite side of said lobe, the fiber having a modification ratio of from about 2.5 to about 7.

20 Claims, 2 Drawing Sheets

MULTILOBAL FIBER WITH PROJECTIONS ON EACH LOBE FOR CARPET YARNS

This is a continuation-in-part of co-pending application Ser. No. 07/967,003 filed on Oct. 27, 1992, now abandoned.

FIELD OF THE INVENTION

The present invention is directed to a multilobal fiber with projections alternating along the contour of each lobe for use on carpet yarns.

BACKGROUND OF THE INVENTION

Multilobal, in particular trilobal fibers and filaments are known in the art and have been widely used, especially for carpet yarns. They show superior properties in bulk and covering power over fibers having round cross sections.

U.S. Pat. No. 3,109,195 discloses filaments having multi-lobed transverse cross-sections.

U.S. Pat. No. 3,194,002 discloses a multifilament yarn having a non-regular Y-shaped cross section.

U.S. Pat. No. 4, 648,830 discloses a spinnerette for producing hollow trilobal cross-section filaments.

U.S. Pat. No. 5,108,838 discloses the trilobal and tetralobal filaments exhibiting low glitter and high bulk. The filaments having substantial convex curves.

Disadvantage of the filaments of the prior art are high luster and high sparkles.

Object of the present invention was to provide a fiber with a simple cross section, which exhibits good bulk, subdued luster, uneven surface, and good soil hiding properties.

Another object was to provide a spinnerette plate with a simple geometry, which is easy to produce and which allows the manufacture of these fibers.

Still another object was to provide a carpet with subdued luster and good soil hiding properties.

SUMMARY OF THE INVENTION

The objects of the present invention could be achieved by a synthetic fiber, having a multilobal cross section, each lobe of said multilobal cross section having a first end and a second end and one side and an opposite side, the first end of each of said lobes being connected to the first end of the other lobes, the second end of each of said lobes radiating outwardly, each lobe having a plurality of projections alternating along a contour of each lobe, each projection on one side of each lobe having no direct counterpart on the opposite side of said lobe, the fiber having a modification ratio of from about 2.5 to about 7.

DETAILED DESCRIPTION OF THE INVENTION

Figure 1:
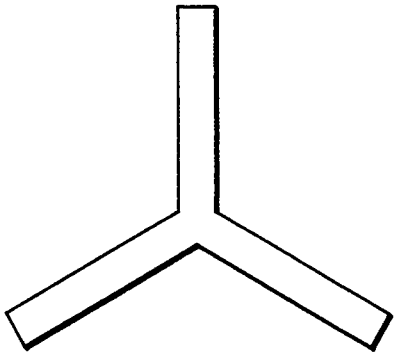
FIG. 1 (PRIOR ART)
FIG. 1 is a front view of a trilobal spinnerette capillary of the prior art.
Figure 1A:
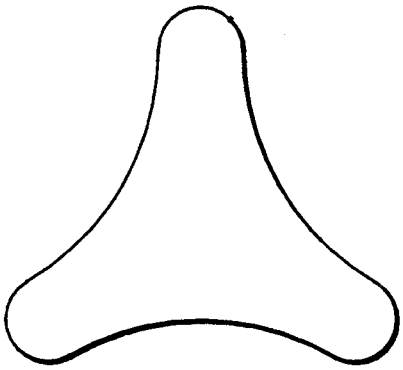
FIG. 1A (PRIOR ART)
FIG. 1*a* is a cross-sectional view of a fiber spun by a spinnerette shown in FIG. 1.

The synthetic fibers of the present invention are generally prepared by melt spinning of a fiber forming polymer through a spinnerette.

Suitable polymers for the production of the fibers of the present invention are all fibers of the present invention are all fiber forming thermoplastic materials especially polyamides, polyesters, and polyolefins. Suitable polyamides are nylon 6, nylon 6/6, nylon 6/9, nylon 6/10, nylon 6/12, nylon 11, nylon 12, copolymers thereof and mixtures thereof.

Preferred polyamides are nylon 6 and nylon 6/6. A suitable polyester is polyethylene terephthalate.

Various additives may be added to the respective polymer. These include, but are not limited to, lubricants, nucleating agents, antioxidants, ultraviolet light stabilizers, pigments, dyes, antistatic agents, soil resists, stain resists, antimicrobial agents, and flame retardants.

The polymer is fed into an extruder in form of chips or granules, (indirect) melted and directed via jacketed Dowtherm ® (Dow Chemical, Midland, Mich.) heated polymer distribution lines to the spinning head. The polymer melt is then metered by a high efficiency gear pump to spin pack assembly and extruded through a spinnerette with capillaries described below.

The spinnerette plate of the present invention has in general at least one multilobal opening, like tris-, tetra-, penta- or hexalobal capillary, preferably tri- and tetralobal capillary.

The capillary of the spinnerette plate of the present invention is described with reference to FIG. 2 for a trilobal opening:

Lobes (1), (2) and (3) have two ends each, (4), (5); (4), (6) and (4), (7). On one end (4) the lobes are connected to each other and The angles between the lobes (1), (2) and (3) are from about 100° to about 140°, preferably about 120°.

The projections (8), (9), (10); (11), (12), (13); (14), (15) and (16) alternate along the contour of each lobe. The number of projections per lobe are from about 2 to about 4, preferably 3.

The projections may be different in each lobe and may have different types of shapes like rectangular, square, triangular or round. Preferred is one type of shape in one spinnerette and is the rectangular or square shape.

Figure 3:
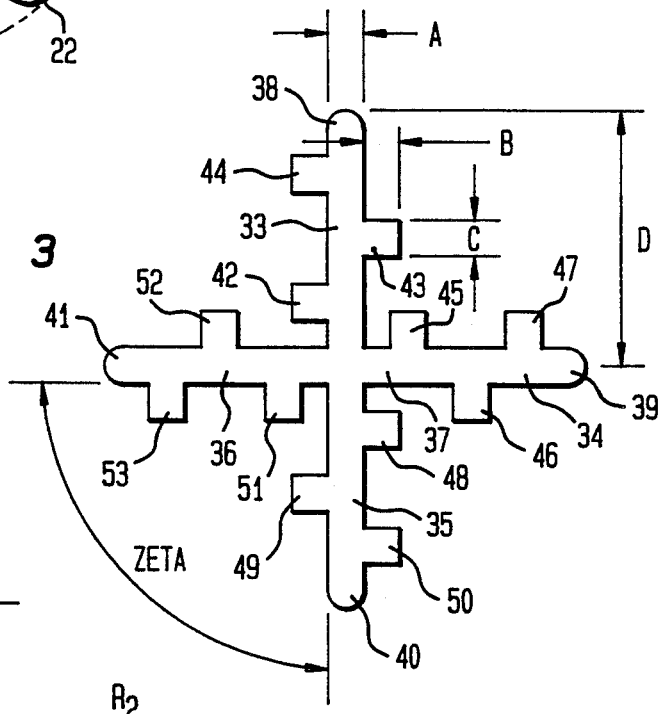
FIG. 3 is a front view of a tetralobal spinnerette capillary of the present invention comprising three alternating projections along the contour of each lobe.

The tetralobal opening in the spinnerette plate according to FIG. 3 has four lobes (33), (34), (35) and (36). On one end (37) the lobes are connected to each other, the other end of each lobe (38), (39), (40) and (41) radiating outwardly. The angles between the lobes (38), (40) and (41) are from about 80° to 100°, preferably about 90°.

The projections (42), (43), (44); (45), (46), (47); (48), (49), (50) and (51), (52) and (53) alternate along the contour of each lobe. The number of projections are from about 2 to about 4, preferably 3.

The dimensions of the different parts and their relationship to each other of the capillary of the present invention are as follows:

A is the width of the lobe

B is the width of the projection

C is the length of the projection

D is the length of the lobe

The dimensions A, B, C and D satisfy the following mathematic relationship:

$1.4 \leqq ((1.73\ D)/A)^{\frac{1}{2}} \leqq 49$; preferably $6.3 \leqq ((1.73\ D)/A) \leqq 30.3$;

$0.5A \leqq B \leqq 2A$; and $0.5A \leqq C \leqq 2A$.

The length in mm of A and B may be:

$0.04\ mm \leqq A \leqq 0.15\ mm$, and $0.06\ mm \leqq D < 3\ mm$.

The angle zeta between the lobes of the trilobal capillary are from about 70° to about 140°, preferably from about 110° to about 130°.

The angle zeta between the lobes of the tetralobal capillary are from about 70° to about 140°, preferably from about 80° to about 100°.

The disclosed dimensions are dependent from for example polymer type, spinning temperature, melt viscosity of the polymer and quench medium.

The desired "modification ratio" for the resulting filaments is also an important factor. By the term, "modification ratio" (MR), it is meant the ratio of the radius of a circle which circumscribes the filament cross-section to the radius of the largest circle which can be inscribed within the filament cross-section.

Figure 2:
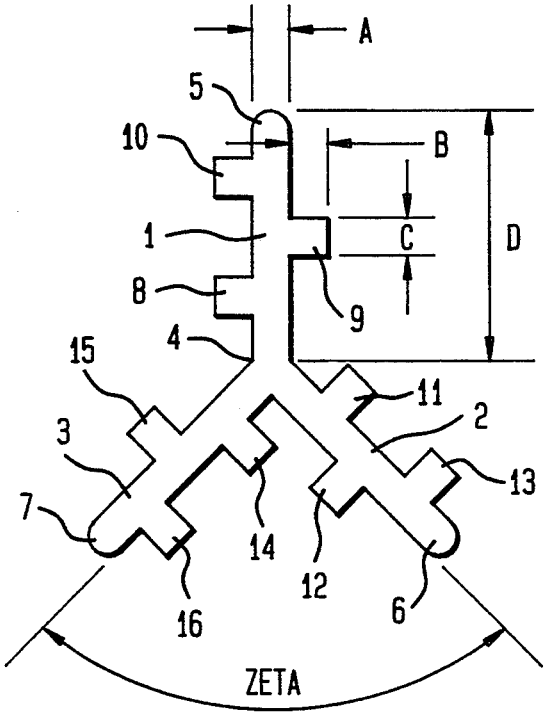
FIG. 2 is a front view of a trilobal spinnerette capillary of the present invention comprising three alternating projections along the contour of each lobe. These projections may be of a specific shape such as a rectangular, square, triangular or round shape.
Figure 2A:
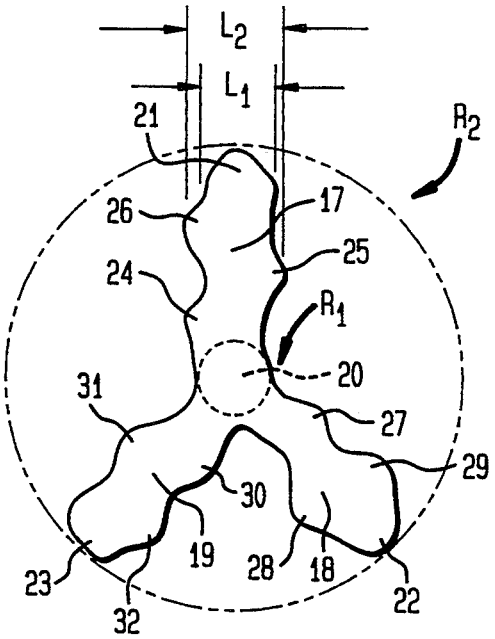
FIG. 2*a* is a cross-sectional view of a fiber spun by a spinnerette shown in FIG. 2.
Figure 3A:
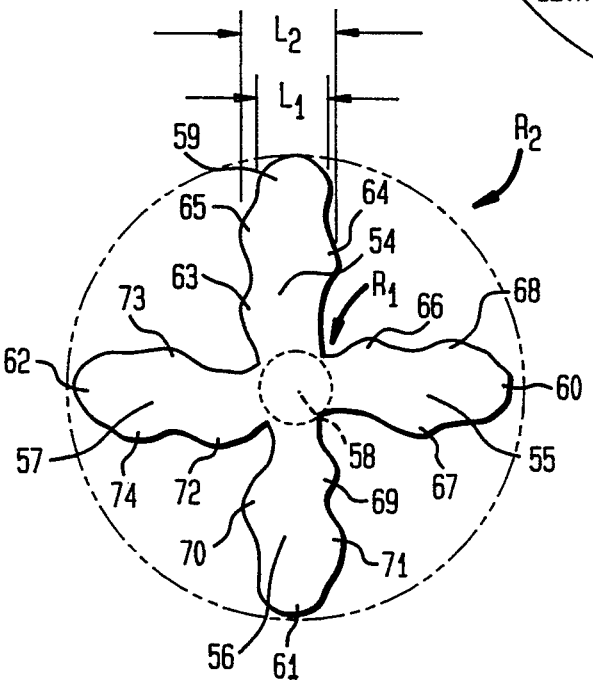
FIG. 3*a* is a cross-sectional view of a fiber spun by a spinnerette shown in FIG. 3.

The two circles are shown as dotted lines in FIG. 2*a* and FIG. 3*a*. The dimensions in the capillaries of the spinnerette plate are shown, that the MR for the cross-section of the resulting fiber is from about 1.2 to about 7, preferably from about 2.5 to about 5.

Another preferred MR is from about 2.5 to about 7.0. Preferred is also a MR of from about 4.5 to about 7.0 and most preferred is from about 4.5 to about 5.0.

The respective polymer is extruded through the capillary of the spinnerette plate described in FIG. 2 or FIG. 3 to form a fiber having a cross-section described in FIG. 2*a* or FIG. 3*a*.

The trilobal cross-section of the fiber according to FIG. 2*a* has three lobes (17), (18) and (19) with two ends each (20), (21); (20), (22); and (20), (23).

Lobe (17) has a first end (20) and a second end (21), lobe (18) has a first end (20) and a second end (22) and a lobe (19) has a first end (20) and a second end (23) .

On one end (20) the lobes are connected to each other, the other end of each lobe (21) (22) and (23) radiating outwardly.

The first end of each lobe is connected to the first end of the other lobes. The first end of the other lobes. The first end (20) of lobe (17) is connected to the first end (20) of lobe (18) and to the first end (20) of lobe (19). The second end of each lobe is radiating outwardly. The second end (21) of lobe (17), the second end (22) of lobe (18) and the second end (23) of lobe (19) are radiating outwardly.

The projections (24), (25), (26); (27), (28), (29) and (30), (31) (32) alternate along the contour of each lobe. According to the shape of the projections in the spinnerette, the projections of the cross section of the fiber differ slightly.

The projections alternate along the contour of each lobe, which means that the projections alternate successively from one side of the lobe to the opposite side of the lobe along the contour of the lobe, thereby having no direct counterpart on the opposite side of the lobe. Following in FIG. 2*a* the contour of lobe (17) from the first end (20) to the second end (21), projection (24) on the left side of lobe (17) alternates with projection (25) on the right side of lobe (17) which alternates with projection (26) on the left side of lobe (17). Projection (24) has no direct counterpart on the opposite side which is the right side of the lobe (17). Projection (25) has no direct counterpart on the opposite side which is the left side of lobe (17) and projection (26) has no direct counterpart of the opposite side which is the right side of lobe (17). The alternation of projections results in an unsymmetrical lobe (17). Following the contour of lobe (18) from the first end (20) to the second end (22), projection (27) on the right side of lobe (18) alternates with projection (28) on the left side, which alternates with projection (29) on the right side of lobe (18). None of the projections (27), (28) and (29) has a direct counterpart on the respective opposite side of lobe (18). The alternation of projections (27), (28) and (29) results in an unsymmetrical lobe (18).

Following the contour of lobe (19) from the first end (20) to the second end (23), projection (30) on the right side of lobe (19) alternates with projection (31) on the left side of lobe (19) which alternates with projection (32) on the right side of lobe (19). None of the projections (30), (31) and (32) has a direct counterpart on the respective opposite side of lobe (19). The alternation of projections (30), (31) and (32) results in an unsymmetrical lobe (19).

The tetralobal cross-section of the fiber according to FIG. 3*a* has four lobes (54), (55), (56) and (57) with two ends each (58), (59); (58), (60); (58) (61) and (58), (62).

Lobe (54) has a first end (58) and a second end (59), lobe (55) has a first end (58) and a second end (60), lobe (56) has a first end (58) and a second end (61) and lobe (57) has a first end (58) and a second end (62).

On one end (58) the lobes are connected to each other and radiating outwardly to the other end of each lobe (59), (60), (61) and (62).

The first end of each lobe is connected to the first end of the other lobes. The first end (58) of lobe (54) is connected to the first end (58) of lobe (55), to the first end (58) of lobe (56) and to the first end (58) of lobe (57). The second end of each lobe is radiating outwardly. The second end (59) of lobe (54), the second end (60) of lobe (55), the second end (61) of lobe (56) and the second end (62) of lobe (57) are radiating outwardly.

The projections alternate along the contour of each lobe, which means that the projections alternate successively from one side of the lobe to the opposite side of the lobe along the contour of the lobe thereby having no direct counterpart on the opposite side of the lobe. Following in FIG. 3*a* the contour of lobe (54) from the first end (58) to the second end (59), projection (63) on the left side of lobe (59) alternates with projection (64) on the right side of lobe (59), which alternates with projection (65) on the left side of lobe (59). Projection (63) has no direct counterpart on the opposite side, which is the right side, projection (64) has no direct counterpart on the opposite side of lobe (59), which is the left side and projection (65) has no direct counterpart on the opposite side of lobe (59), which is the left side and projection (65) has no direct counterpart on the opposite side of lobe (59) which is the right side. The alternation of projections (63), (64) and (65) results in an unsymmetrical lobe (54).

Following the contour of lobe (55) from the first end (58) to the second end (60), projection (66) on the top side alternates with projection (67) on the bottom side, which alternates with projection (68) on the top side of lobe (55). Projection (66) has no direct counterpart on the opposite side of lobe (55), which is the bottom side, projection (67) has no direct counterpart on the opposite side of lobe (55), which is the tops side and projection (68) has no direct counterpart on the opposite side of lobe (55), which is the bottom side. The alternation of projections (66), (67) and (68) results in an unsymmetrical lobe (55).

Following the contour of lobe (56) from the first end (58) to the second end (61), projection (69) on the right side of lobe (56) alternates with projection (70) on the left side of lobe (56), which alternates with projection (71) on the right side of lobe (56). Projection (69) has no direct counterpart on the opposite side of lobe (56), which is the left side, projection (70) has no direct counterpart on the opposite side of lobe (56), which is the right side and projection (71) has no direct counterpart on the opposite side of lobe (56), which is the left side of lobe (56). The alternation of projections (69), (70) and (71) results in an unsymmetrical lobe (56).

Following the contour of lobe (57) from the first end (58) to the second end (62), projection (72) on the bottom side of lobe (57) alternates with projection (73) on the top side of lobe (57) which alternates with projection (74) on the bottom side of lobe (57). Projection (72) has no direct counterpart on the opposite side of lobe (57), which is the top side. Projection (73) has no direct counterpart on the opposite side of lobe (57) which is the bottom side and projection (74) has no direct counterpart on the opposite side of lobe (57) which is the top side. The alternation of projections (72), (73) and (74) results in an unsymmetrical lobe (57).

The lobes and diameters of the fiber of the present invention satisfy the following mathematical relationships:

L1 is the narrowest width of the lobe;

L2 is the widest width of the lobe;

R1 is the inner fiber diameter; and

R2 is the outer fiber diameter

The dimensions L1, L2, R1 and R2 satisfy the following relationship:

$1.2 \leqq R2/R1 \leqq 7.0$; preferably $2.5 \leqq R2/R1 \leqq 5.0$;

$1.1\ L1 \leqq L2 \leqq 5\ L1$; and $L1 \leqq L2 \leqq R1$.

The spinnerette plate of the present invention has from about 5 to about 300 openings in form of the capillaries, described above, preferably from about 10 to about 200.

The extruded fibers are quenched for example with air in order to solidify the fibers. The fibers are then treated with a finish comprising a lubricating oil or mixture of oils and antistatic agents. The fibers are then combined to form a yarn bundle which is then wound on a suitable package.

In a subsequent step, the yarn is drawn and texturized to form a bulked continuous filament (BCF) yarn suitable for tufting into carpets. A more preferred technique involves combining the extruded or as-spun filaments into a yarn, then drawing, texturizing and winding a package, all in a single step. This one-step method of making BCF is referred to in the trade as spin-draw-texturing.

Nylon fibers or filaments for the purpose of carpet manufacturing have deniers (denier=weight in grams of a single filament with a length of 9000 meters) in the range of about 3 to 75 denier/filament (dpf). A more preferred range for carpet fibers is from about 6 to 35 dpf.

From here, the BCF yarns can go through various processing steps well know to those skilled in the art. The fibers of this invention are particularly useful in the manufacture of carpets for floor covering applications.

To produce carpets for floor covering applications, the BCF yarns are generally tufted into a pliable primary backing. Primary backing materials are generally selected from the group comprising conventional woven jute, woven polypropylene, cellulosic nonwovens and nonwovens of nylon, polyester, and polypropylene. The primary backing is then coated with a suitable latex material such as conventional styrene-butadien latex, vinylidene chloride polymer, or vinyl chloride-vinylidene chloride copolymers. It is common practice to use fillers such as calcium carbonate to reduce latex costs. The final step is to apply a secondary backing, generally a woven jute or woven synthetic such as polypropylene.

EXAMPLES 1

Nylon 6 filaments were spun using three of the modified cross-section spinnerettes. Each spinnerette had 12 capillaries of a specific design of such as that in FIG. 2A with the following dimensions:

A=0.08 mm

B=0.08 mm

C=0.08 mm

D=0.96 mm

The angle zeta was 120°.

The nylon 6 polymer (rel. viscosity RV=2.7) used was a bright polymer and did not contain any delusterant. The polymer temperature was controlled at the pump block at about 265° C.±1° and the spinning throughput was 66.75 g/min per spinnerette.

The molten fibers were quenched in a chimney using 80 ft/min air for cooling the fibers. The filaments were pulled by a feed roll rotating at a surface speed of 865 m/min through the quench zone and coated with a lubricant for drawing and crimping.

The yarns were combined and drawn at 1600 m/min and crimped by a process similar to that described in U.S. Pat. No. 4,095,317 to form 1100 denier 60 filament yarn.

The spun, drawn, and crimped yarns (BCF) were cable-twisted to a 3.5 turns per inch (tpi) on a cable twister and heat-set on a Superba heat-setting machine at the standard conditions for nylon 6 BCF yarns.

The test yarns were then tufted into 32 oz/sq. yd., 3/16 gauge cut pile constructions. The test carpets were compared with carpets made from production machines running nylon 6 BCF carpet yarns in a one-step and two-step process.

The carpet properties were assessed by a panel of experts and the results are shown in table 1.

TABLE 1

| yarns | | cross-section | luster | bulk |
|---|---|---|---|---|
| 1. | control, two-step | 3.2 MR trilobal | high | medium-high |
| 2. | control, one step | 3.2 MR trilobal | high | medium |
| 3. | Example 1 | 5.0 MR trilobal | low | medium-high |

MR: modification ratio

EXAMPLE 2

Nylon 6 (RV=2.7) filaments were spun using three of the modified cross-section spinnerettes using the above-described process for the main extruder and with a sidearm extruder attached to the main extruder. The sidearm extruder was fed with a nylon 6 polymer blended with color concentrates to produce yarns of red, blue, and green colors.

The polymer temperature was controlled at the pumpblock at about 265° C.±1° and the spinning throughput was 55.0 g/min per spinnerette.

The filaments were drawn on a drawtwister at a draw ratio of 3:10 to a final denier of 220/12 filament and combined on an air texturing machine. A yarn with a denier of 200/35 filament was used as the core yarn and the green, red, and blue yarns were used as accent yarns and textured to give a space-dye look in carpet.

The carpets were 25 oz level loop and were compared to carpets made by the same process using the same blends of colors. The comparative carpets were using a trilobal cross-section yarn drawn to a final denier of 220/14 filament. Results are shown in table 2.

TABLE 2

| yarns | | cross-section | texture |
|---|---|---|---|
| 1. | Control | round | fair |
| 2. | Control | 2.6 MR trilobal | good |
| 3. | Example 2 | 4.6 MR trilobal | good |

MR: modification ratio

I claim:

1. A synthetic fiber, having a multilobal cross section, each lobe of said multilobal cross section having a first end and a second end and a one side and an opposite side, the first end of each of said lobes being connected to the first end of the other lobes, the second end of each of said lobes radiating outwardly, each lobe having a plurality of projections such that each projection of one side of each lobe has no direct counterpart on the opposite side of said lobe, and wherein the fibers has a modification ratio of from about 2.5 to about 7.

2. The fiber according to claim 1, wherein the dimensions of said fiber and said lobes satisfy the following mathematic relationship:

$1.2 \leqq R2/R1 \leqq 7.0$;

$1.1\ L1 \leqq L2 \leqq 5\ L1$; and $L1 \leqq L2 \leqq R1$;

wherein

L1 is the narrowest width of the lobe;

L2 is the widest width of the lobe;

R1 is the inner fiber diameter;

R2 is the outer fiber diameter.

3. The fiber according to claim 2, wherein $2.5 \leqq R2/R1 \leqq 7.0$;

$1.1\ L1 \leqq L2 \leqq 5\ L1$; and $L1 \leqq L2 \leqq R1$.

4. The fiber according to claim 1, wherein the cross section is trilobal.

5. The fiber according to claim 2, said fiber having three projections.

6. The fiber according to claim 1, wherein the cross section is tetralobal.

7. The fiber according to claim 6, said fiber having three projections.

8. The fiber according to claim 1, comprising a polymer selected from the group consisting of polyamide, polyester and polyolefin.

9. The fiber according to claim 8, wherein said polyamide is selected from the group consisting of nylon 6, nylon 6/6, nylon 6/9, nylon 6/10, nylon 6/12, nylon 11, nylon 12, copolymers thereof and mixtures thereof.

10. The fiber according to claim 9, wherein said polyamide is nylon 6 or nylon 6/6.

11. The fiber according to claim 1, having a modification ratio of from about 4.5 to about 7.

12. A carpet comprising a fiber according to claim 1.

13. The fiber according to claim 11, having a modification ratio of from about 4.5 to about 5.

14. The fiber according to claim 1, having a modification ratio of from about 2.5 to about 5.

15. The fiber according to claim 1, wherein the shape of each of said projections is selected from the group consisting of rectangular, square, triangular and round.

16. The fiber according to claim 15, wherein the shape of each of said projections is rectangular or square.

17. The fiber according to claim 4, wherein the angle zeta between said lobes is from about 70° to about 140°.

18. The fiber according to claim 17, wherein the angle zeta between said lobes is from about 110° to about 130°.

19. The fiber according to claim 6, wherein the angle zeta between said lobes is from about 70° to about 140°.

20. The fiber according to claim 19, wherein the angle zeta between said lobes is from about 80° to about 100°.

* * * * *